US006260218B1

(12) United States Patent
Tsuga

(10) Patent No.: US 6,260,218 B1
(45) Date of Patent: Jul. 17, 2001

(54) TRAVELING LIFT

(75) Inventor: Sueoki Tsuga, Okayama (JP)

(73) Assignee: Mechatec Co., Ltd., Okayama (JP)

( * ) Notice: Subject to any disclaimer, the term of this patent is extended or adjusted under 35 U.S.C. 154(b) by 0 days.

(21) Appl. No.: 09/432,655

(22) Filed: Nov. 3, 1999

(30) Foreign Application Priority Data

Nov. 4, 1998 (JP) ..... 10-313812

(51) Int. Cl.[7] ..... A61G 7/10
(52) U.S. Cl. ..... 5/86.1; 5/87.1
(58) Field of Search ..... 5/81.1 R, 83.1, 5/85.1, 86.1, 87.1, 89.1

(56) References Cited

U.S. PATENT DOCUMENTS 1,878,785 * 9/1932 Leavitt ..... 5/86.1
2,962,730 * 12/1960 Carnes et al. ..... 5/86.1
3,829,916 * 8/1974 James ..... 5/83.1
3,940,808 * 3/1976 Petrini ..... 5/83.1
5,153,953 * 10/1992 Sumrall ..... 5/86.1

FOREIGN PATENT DOCUMENTS

338272 * 6/1959 (CH) ..... 5/87.1
2222814A * 3/1990 (GB) ..... 5/87.1
5-137757 6/1993 (JP) .
9-580 1/1997 (JP) .

* cited by examiner

*Primary Examiner*—Michael F. Trettel
(74) *Attorney, Agent, or Firm*—Koda & Androlia

(57) ABSTRACT

A traveling lift comprises a substantially T-shaped leg unit 4 provided with freely rollable casters 11, 21, 31, a tubular support post 5 set up on the leg unit 4, and an inner post 6 inserted in the support post 5 and provided with a suspension arm 7 at a front portion thereof. The suspension arm 7 is positioned above the front leg 3 so as to extend substantially in parallel therewith. The inner post 6 is formed movably in the vertical direction in the support post 5 by a driving means. This enables a physically handicapped person to be lifted and lowered easily even by a small force, the lift as a whole to be folded to small dimensions lightly and simply, and the folded lift to be transported by car with ease.

2 Claims, 8 Drawing Sheets

TRAVELING LIFT

BACKGROUND OF THE INVENTION

1. Field of the Invention

This invention relates to an improvement of a small-sized mobile lift used to transfer a physically handicapped person and a heavy object, and more particularly to a lift used suitably when a physically handicapped person gets on and off a passenger car, and when baggage is loaded into a passenger car and unloaded therefrom.

2. Description of the Prior Art

In order to transfer a physically handicapped person who needs to be nursed because of his disease, the injury to him and his old age, a lot of labor is required. Under the circumstances, nursing lifts of various systems and shapes for helping a nursing person have heretofore been proposed.

The typical nursing lifts include a lift fixed to a frame of a bed and used when a person to be nursed is transferred from the bed onto a wheelchair, and a lift fixed to a ceiling and a fixed support post and used when a person to be nursed is made to take a bath. However, such fixed type nursing lifts cannot be used, for example, when a person to be nursed sitting on a wheelchair gets on a passenger car and gets off the same to sit on the wheelchair outdoors. In view of the matter, small-sized mobile lifts have come to be proposed in recent years.

For example, Japanese Patent Laid-Open No. 137757/1993 proposes a nursing lift for vehicles, formed by providing a parallel link mechanism on a substantially U-shaped base member having traveling wheels, and fixing a seat type suspension member to the horizontal portion of the link mechanism which is positioned above the parallel link mechanism. This lift enables the suspension member to be inserted between the bottom of a person to be nursed sitting on a wheelchair and a seat of the wheelchair, the suspension member to be lifted by the horizontal portion of the lift, the base member of the life to be then moved under a chassis of a passenger car, and the lifted person to be nursed to be transferred onto a seat of the passenger car and sat thereon.

Japanese Patent Laid-Open No 580/1997 proposes a lift formed by setting up removable support posts on a base frame provided with casters on a lower surface thereof, and connecting a horizontal tubular arm to upper end portions of the support posts via a gear case. In this lift, a lifting rope is fixed to a retainer seat for putting thereon an object person, and this rope is taken up around a shaft provided in the tubular arm to enable the person being nursed to be lifted. The base frame and support posts are formed so that they can be disassembled and assembled.

However, the lift disclosed in Japanese Patent Laid-Open No. 137757/1993 has large overall dimensions, so that it is difficult to transport the same. Therefore, even when an object person is put on an automobile with effort by using the lift, a special lift for making the object person to get off the automobile is required in each of his destinations. In order to stably lift an object person, a width of the substantially U-shaped base frame necessarily increases, so that it becomes impossible that the lift makes a small turn.

In the lift disclosed in Japanese Patent Laid-Open No. 580/1997, a considerably large force is required to lift a physically handicapped person with the rope taken up around the shaft in the tubular arm. Although the transporting of the lift is possible, the lift assembling and disassembling work is troublesome.

Therefore, in the present invention, it has been decided to discuss a traveling lift which enables a person to be nursed to be lifted and lowered easily even by a small force, and the lift itself to be formed simply and foldably to small overall dimensions and light weight and transported easily by an automobile.

SUMMARY OF THE INVENTION

The basic construction of the traveling lift according to the present invention is as follows. First, this traveling lift is formed by a substantially T-shaped leg unit comprising two short lateral legs and one long front leg and provided with freely rollable casters on the portions of these legs which are in the vicinity of free ends thereof, a tubular support post set up on the leg unit, and an inner post inserted in the support post and provided with a suspension arm at a front portion thereof, the suspension arm being disposed so as to be positioned above and substantially in parallel with the front leg, the inner post being formed so that it can be moved vertically in the tubular support post by a driving means.

This traveling lift employs a substantially T-shaped leg unit which is not seen at all in a conventional traveling lift, and which comprises two short lateral legs and one long front leg, so that a width covered by the lift during an operation for lifting and transferring a person to be nursed, and a radius of rotation thereof can be set to low levels.

Secondly, the two lateral legs and one front leg in this traveling lift are formed foldably at the sections thereof which are in the vicinity of root portions thereof, and the suspension arm therein is also formed foldably with the inner post.

Since all of the parts put in a projecting state when the lift is used in practice are thus formed foldably, the lift as a whole can be collapsed compactly when it is transported and stored.

Thirdly, to form a driving means for lifting and lowering the suspension arm in the traveling lift of the basic construction referred to in the above first paragraph, parts are provided which include an upper guide roller for supporting in a rollable state a front side surface of the inner post at the portion of the tubular support post which is close to a front leg-side upper end thereof; a lower guide roller for supporting in a rollable state a rear inner wall of the tubular support post at the portion of the inner post which is in the vicinity of a lower end thereof; a rack gear formed on a rear side surface of the inner post; and a pinion gear transmitting power from a worm gear driven by a handle.

Accordingly, when a person to be nursed is suspended from the suspension arm to cause a downward load to be imparted to a free end portion thereof, the inner post inserted in the tubular support post and inclined forward is put in an engaged state only by the rack gear formed on the rear side surface of the inner post and the pinion gear meshed therewith as the inner post is supported in a rollable state on the upper and lower guide rollers, and then the more the load is imparted to the suspension arm, the more the inner post is inclined forward so as to be pressed against the upper guide roller. Consequently, the rack gear formed on the rear side surface of the inner post is moved away from the pinion gear. If the rack and pinion gear are pressed, an excessive force is imparted to the meshed portions thereof but, the present invention works more effectively to prevent the rack gear and pinion gear from being pressed the larger the load imparted to the suspension arm becomes. As a result, the inner post becomes able to be moved vertically by a small force.

BRIEF DESCRIPTION OF THE DRAWINGS

FIG. 8 is a side view of an example of a handle foldably formed, wherein:

Figure 1:
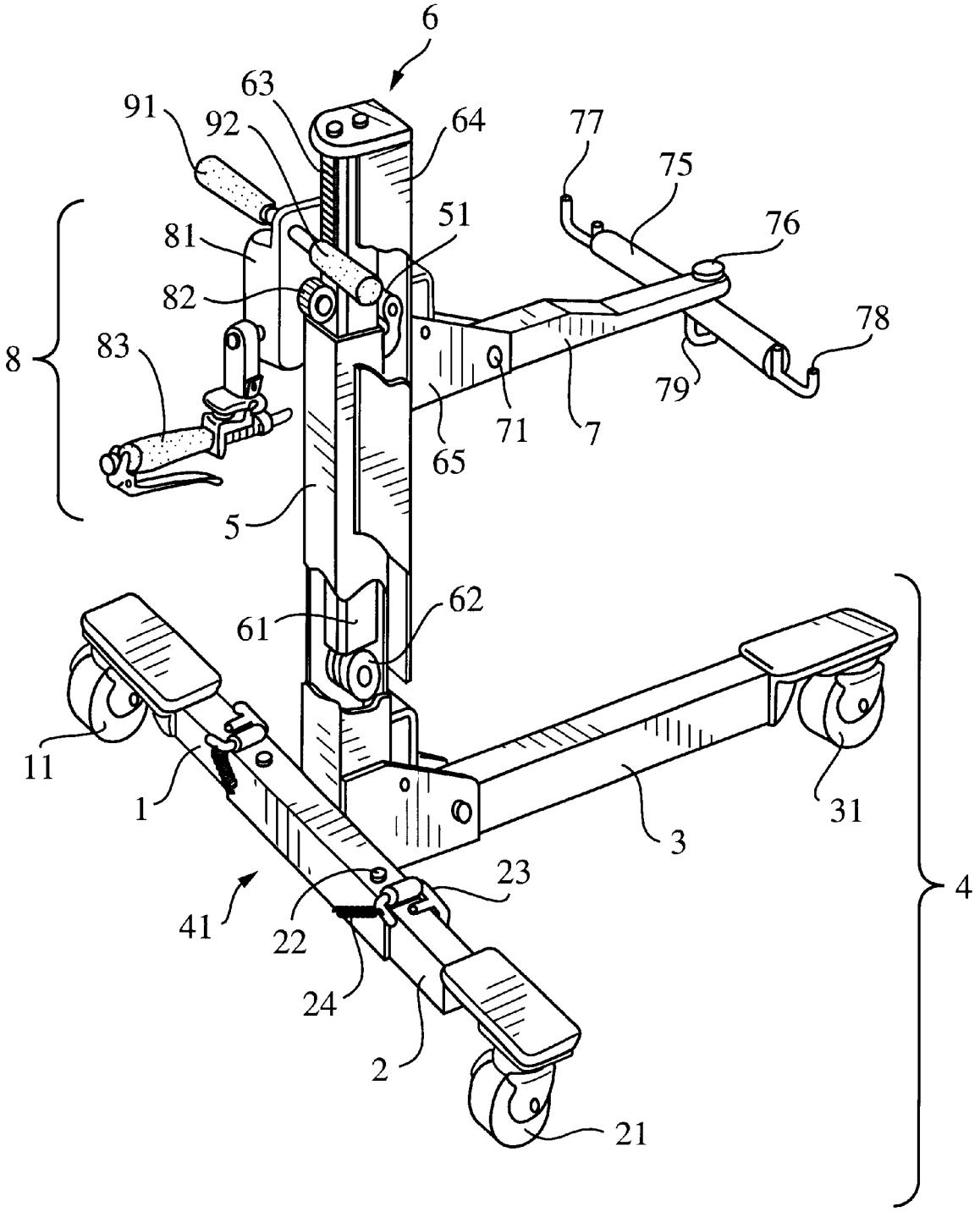
FIG. 1 is a partially cutaway view in perspective showing an example of the traveling lift according to the present invention.
Figure 9:
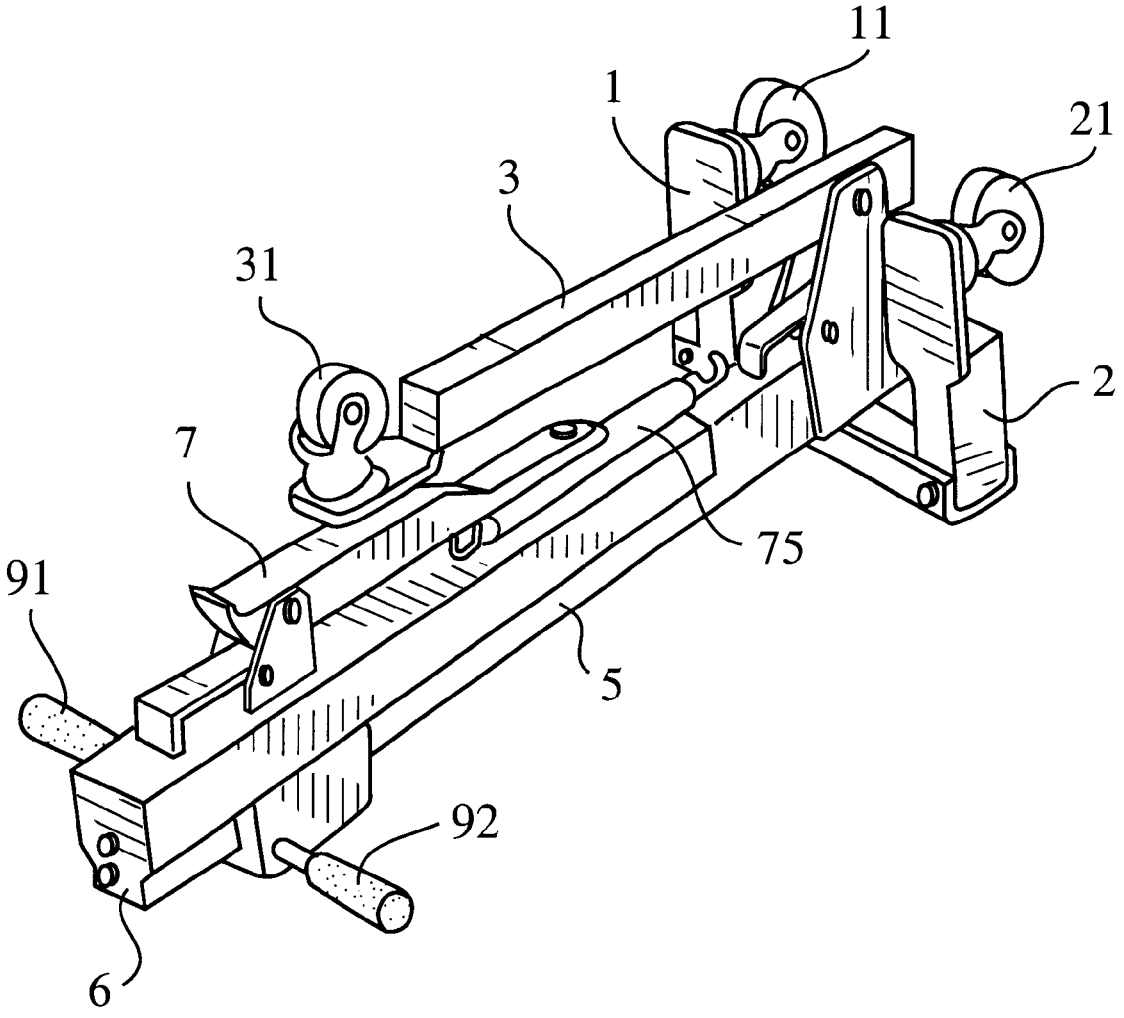
Figure 10:
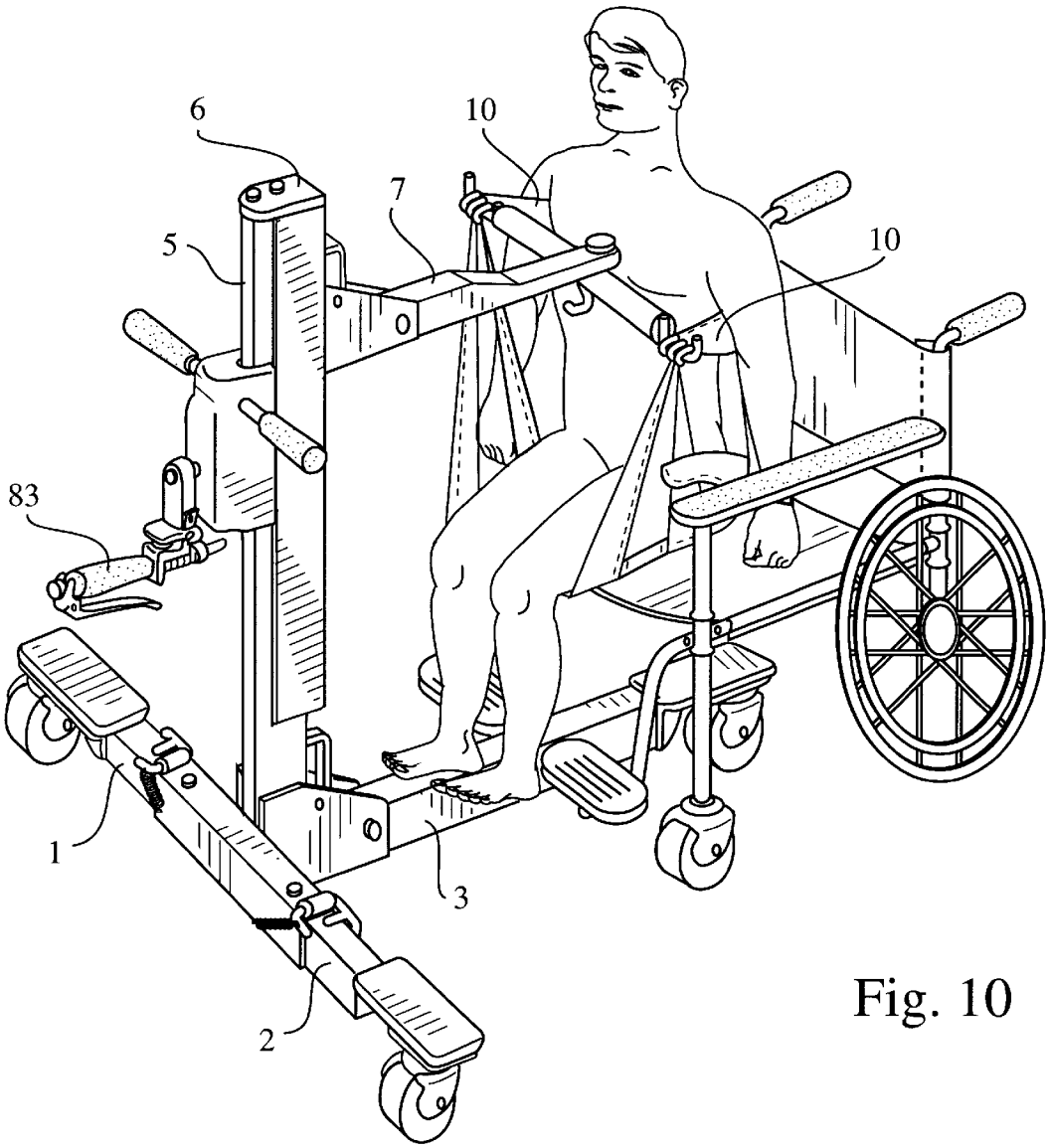
Figure 11:
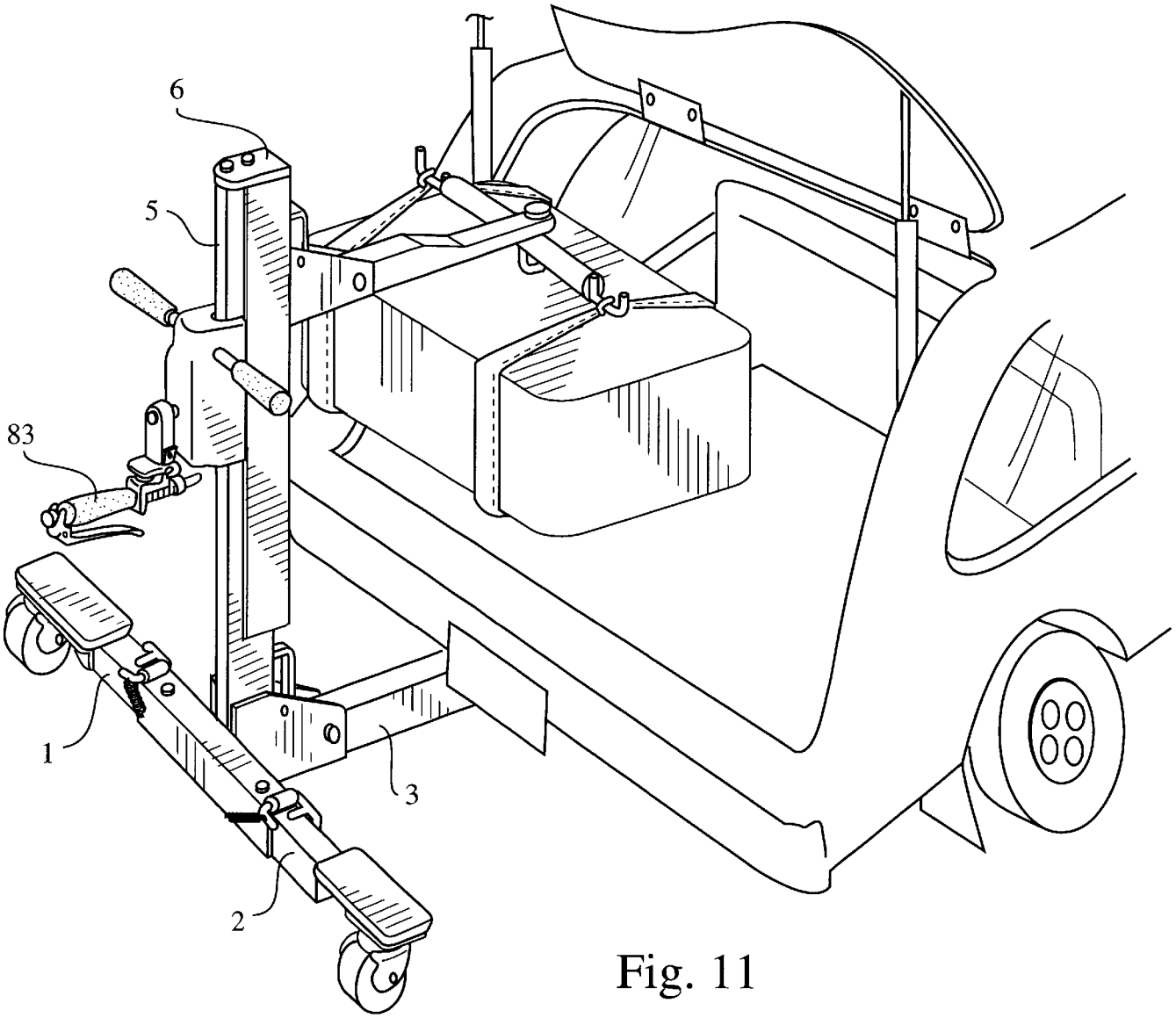

(a) shows a stopped condition thereof, (b) shows a pivotable condition thereof, and (c) shows a folded condition thereof;

FIG. 9 is a perspective view showing a completely folded condition of the traveling lift according to the present invention shown in FIG. 1;

FIG. 10 is a perspective view showing the condition of a person to be nursed sitting on a wheelchair suspended from the traveling lift according to the present invention; and FIG. 11 is a perspective view showing baggage being loaded into a trunk of a passenger car by using the traveling lift according to the present invention.

DESCRIPTION OF THE PREFERRED EMBODIMENT

The traveling lift according to the present invention will now be described in detail with reference to the drawings. As shown in FIG. 1, the traveling lift according to the present invention is formed by a substantially T-shaped leg unit 4 comprising left and right short lateral legs 1, 2, and one long front leg 3, a tubular support post 5 set up on the leg unit, an inner post 6 inserted in the support post, and a suspension arm 7 fixed to an upper portion of the inner post 6. In order to reduce the weight of the lift as a whole while securing the strength thereof, it is preferable that these members be formed as far as possible out of a hollow material comprising a light metal, such as aluminum, and a reinforced plastic material.

In this example of the traveling lift, the fixed type leg unit 4 is formed by joining the left and right lateral legs 1, 2 and front leg 3 to a substantially T-shaped base frame 41 so as to render these legs 1, 2, 3 foldable. The fixed type leg unit 4 may also be formed by directly fixing all of the left and right lateral legs 1, 2 and front leg 3 to one another without using the base frame 41. In any of the folding type and fixed type traveling lifts, freely rollable casters 11, 21, 31 are attached to the portions of the left and right lateral legs 1, 2 and front leg 3 which are close to free ends thereof, in such a manner that the lift as a whole can be used as it is moved.

As will be described later, the suspension arm 7 for lifting a person to be nursed and baggage is disposed so as to be positioned above and substantially in parallel with the front leg 3, so that a load is necessarily imparted to the front leg 3 in the main among all the parts of the lift. Therefore, both of the left and right lateral legs 1, 2 may be formed shorter than the front leg 3 since the former legs mainly function as parts for preventing the lift from falling laterally. When the leg unit 4 as a whole is formed to a large longitudinal size by rather setting the length of the left and right lateral legs 1, 2 to such a lowest possible level that is within the range permitting the prevention of the falling of the lift as compared with that of the front leg 3, a traveling lift having a minimized width and capable of making a small turn even in a narrow place can be obtained.

Figure 2:
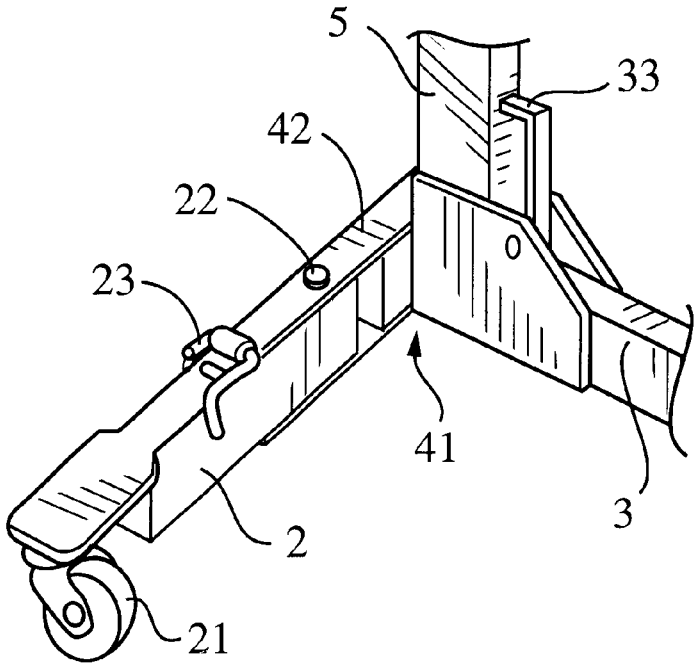
FIG. 2 is a partial perspective view of the portion of the example of the traveling lift of FIG. 1 which is in the vicinity of a right lateral leg.
Figure 3:
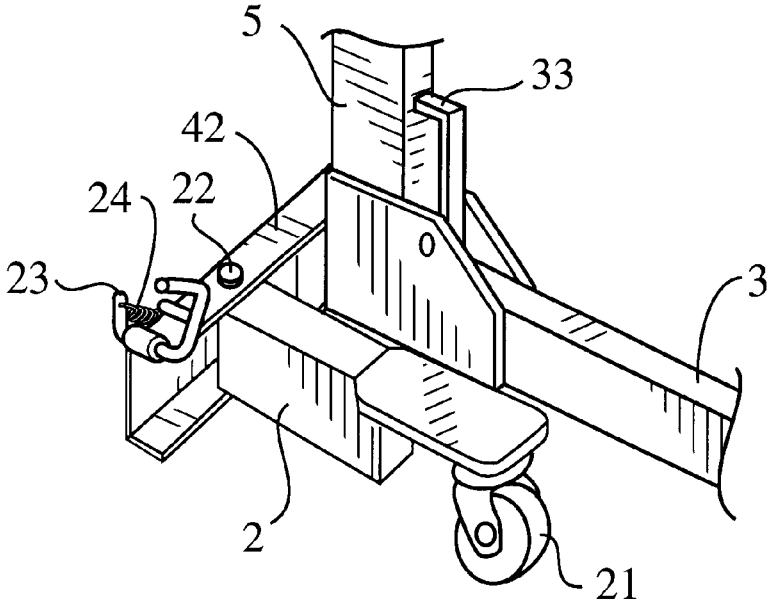
FIG. 3 is a partial perspective view showing a folded state of the right lateral leg of FIG. 2.

As shown in FIGS. 2 and 3, the right lateral leg 2 formed in the shape of a hollow box frame except a free end portion thereof to which the freely rollable caster 21 is fixed is pivotably connected via a lateral leg fixing shaft 22 to relative one of channel members 42, which are provided on the base frame 41 so as to extend leftward and rightward, in such a manner that a rear end portion of the right lateral leg 2 is held in an end portion of the channel member 42. When the lateralleg lift is in use, the right lateral leg 2 is positioned on an extension of the end portion of the channel member 42, and fixed by a stopper 23 provided on an upper edge of the end portion of the channel member 42. When the stopper 23 is turned up to unlock the right lateral leg 2, the latter is folded in the forward direction. Since a rear end portion of the lateral leg stopper 23 is joined to the channel member 42 via a tension spring 24, the non-intended releasing of the lateral leg stopper 23 is prevented by utilizing a tensile force of the tension spring 24, whereby the securing of the safety of the lift in use is attained.

Figure 4:
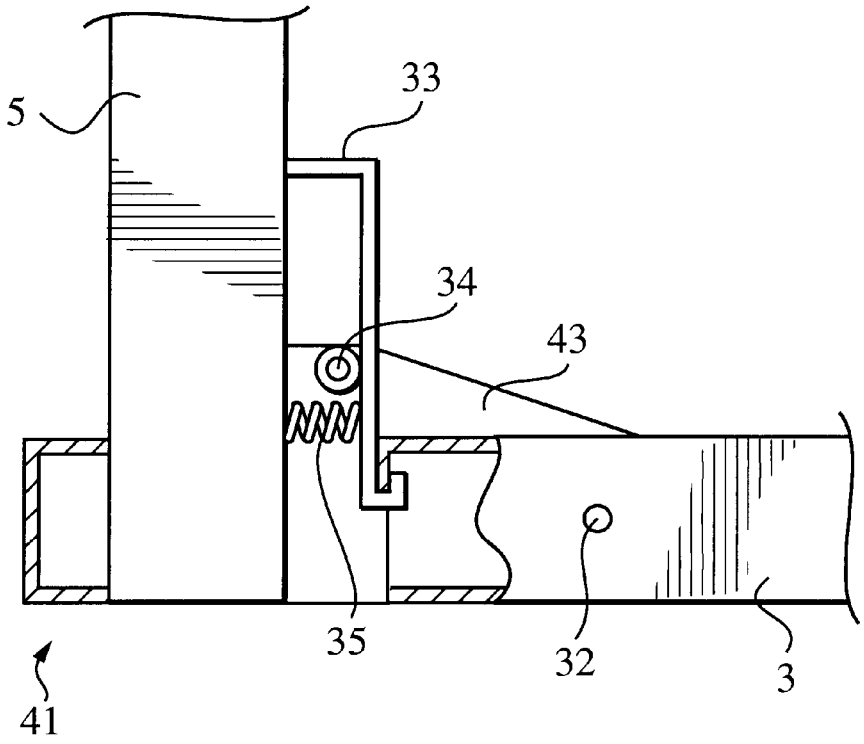
FIG. 4 is a partially cutaway side view of the section of the example of the traveling lift of FIG. 1 which is in the vicinity of a root portion of a front leg.
Figure 5:
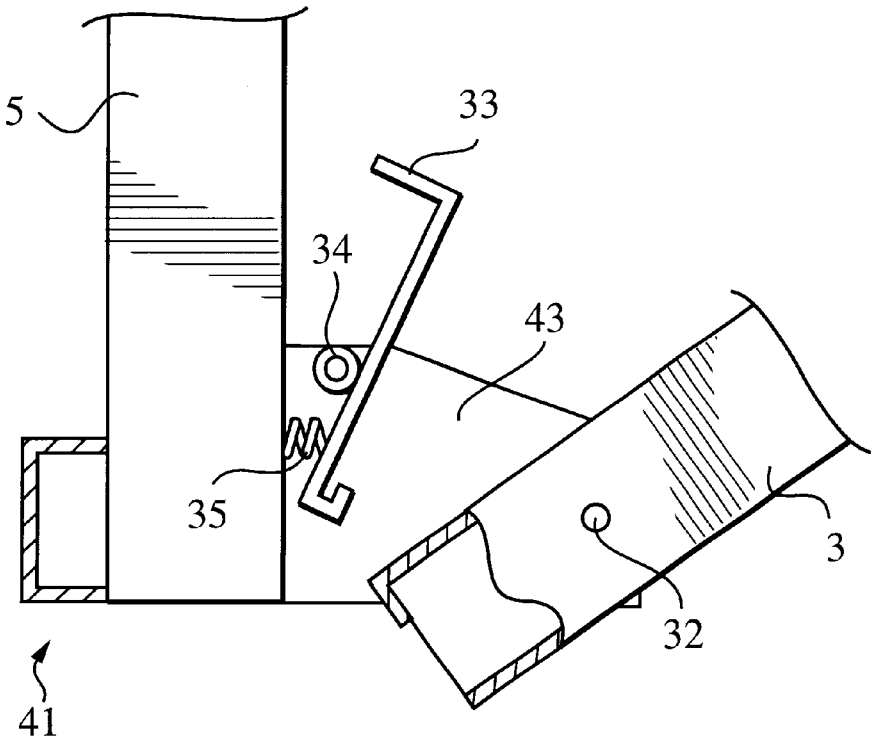
FIG. 5 is a partially cutaway side view showing the condition of the front leg being folded from the condition thereof shown in FIG. 4.

As shown in FIGS. 4 and 5, the front leg 3 formed in the shape of a hollow box frame except the free end portion thereof to which the freely rollable caster 31 is attached is pivotably joined via a front leg support shaft 32 between two support plates 43 in the base frame 41. Between the two support plates 43, a front leg stopper 33 formed by bending a plate type material substantially to the shape of the letter "L" is pivotably joined via a rotary shaft 34. The upwardly bent lower end portion of the front leg stopper 33 and a downwardly bent rear end portion of the front leg 3 are engaged with each other to support the front leg 3 in a position in which the front leg 3 extends at right angles to the support post 5, whereby the lift becomes ready to be used.

The portion of the front leg stopper 33 which is in the vicinity of a lower end thereof is supported on the support post 5 via a compression spring 35. Accordingly, the engagement of the front leg stopper 33 and front leg 3 with each other is broken off only by turning up the rear end portion of the front leg 3, i.e., turning down the free end portion thereof around the front leg support shaft 32 with the upper portion of the front leg stopper 33, which is always in close contact with the support post 5, pulled forcibly in the forward direction. Namely, in order to transfer the condition of use of the lift shown in FIG. 4 to that of the folding of the front leg 3 shown in FIG. 5, it is necessary that the upper portion of the front leg stopper 33 be once pulled forward, i.e., in the direction opposite to the direction in which a load is imparted thereto during the use of the lift as the free end portion of the front leg 3 is lowered. Thus, the non-intended releasing of the front leg stopper 33, which causes the front leg 3 to be folded, is prevented, and this is of a help toward the security of safety of the lift in use.

The tubular support post 5 is set up on the substantially T-shaped leg unit 4 comprising left and right lateral legs 1, 2 and a front leg 3 all of which are joined foldably via shafts to the base frame 41. In the example of FIG. 1, the support post 5 is formed by using a cross-sectionally square tubular member, and a lower end portion of the support post 5 is fixed between the support plates 43 of the base frame 41 to which the front leg 3 is joined via a shaft, an upper guide roller 51 being also fixed to a front leg side 3 upper end portion of the support post.

The inner post 6 is inserted in the support post 5. The inner post 6 in the example of FIG. 1 is provided with a lower guide roller 62 at a lower end of a square pole type inner post body 61, and a rack gear 63 is formed on a rear side surface thereof. A pinion gear 82 provided on a gear box 81, which is provided on a left side surface of the support post 5, so as to project therefrom is meshed with this rack gear 63, and the inner post body 61 are held between the pinion gear 82 and the guide roller 51. Therefore, when the pinion gear 82 is rotated forward and backward, the rotation thereof is transmitted to the rack 63 to cause the inner post body 61 to be moved up and down in the support post 5. The suspension arm 7 is joined to a front portion of the inner post 6 via a shaft and two suspension arm support plates 65 fixed to an inner post cover 64, in such a manner that the suspension arm 7 extends above and substantially in parallel with the front leg 3.

Thus, the inner post cover 64 put on the inner post body 61 (1) prevents the fingers from being involved between the upper guide roller 51 and inner post body 61, or between the upper end of the support post 5 and the inner post body 61, for example, when the suspension arm 7 is moved up and down, and (2) works so as to enable the suspension arm 7 to be moved to a position lower than that in a case where a suspension arm 7 is fixed directly to an upper portion of an inner post body 61. The inner post cover 64 in the example of FIG. 1 comprises an elongated channel material, an upper end portion of which is fixed to that of the inner post body 61, and it houses the upper guide roller 51 therein while it substantially encloses front and right side surfaces of the inner post body 61. Consequently, the upper guide roller 51 in this example rolls on and supports a front side surface of the inner post body 61 and also a front inner wall of the inner post cover 64 at once.

Figure 6:
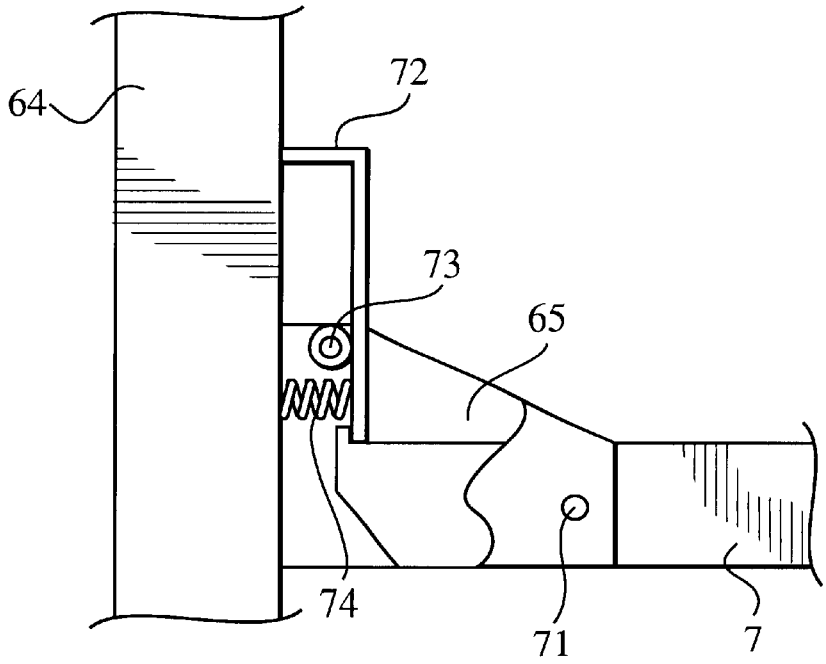
FIG. 6 is a partially cutaway side view showing the portion of an inner post cover which is in the vicinity of a suspension arm fixed portion thereof.

FIG. 6 is a partially cutaway side view of the portion of the inner post cover 64 which is in the vicinity of a portion thereof to which the suspension arm 7 is fixed. In this example, the suspension arm 7 is joined in a position between the two suspension arm support plates 65, which are set up at the front side of the inner post cover 64, to the inner post cover 64 via a suspension arm support shaft 71. Between the same two suspension arm support plates 65, a suspension arm stopper 72, which is formed by bending a plate type material substantially to the shape of the letter "L", is fixed via a rotary shaft 73. Since a lower end portion of the suspension arm stopper 72 and an upwardly bent rear end portion of the suspension arm 7 are engaged with each other, the suspension arm 7 is supported so as to extend at right angles to the inner post cover 64, i.e. the inner post 6.

Figure 7:
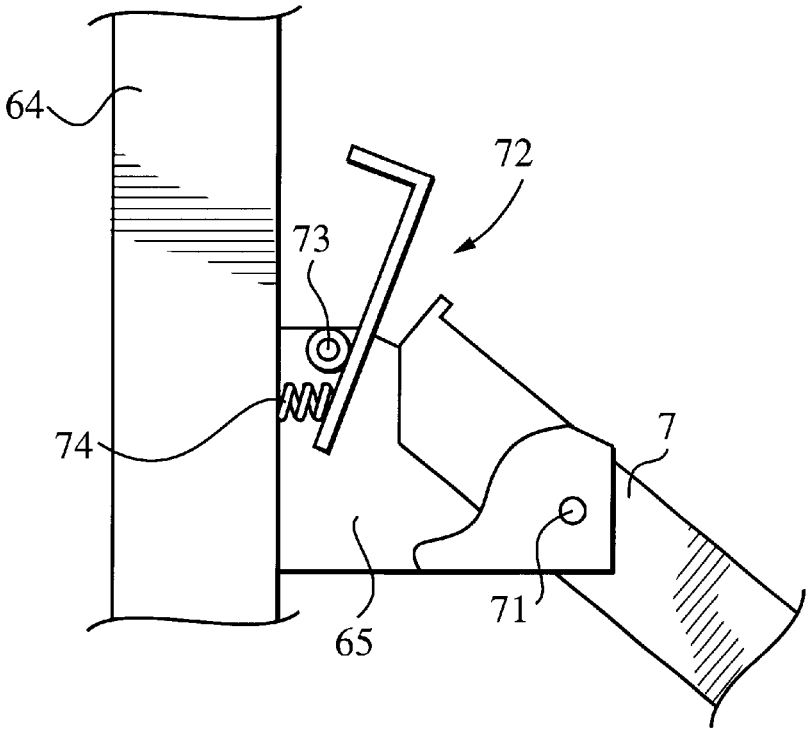
FIG. 7 is a partially cutaway side view showing the condition of the suspension arm being folded from the condition thereof shown in FIG. 6.

The portion of the suspension arm stopper 72 which is in the vicinity of the lower end thereof is supported on the inner post cover 64 via a compression spring 74. Therefore, the engagement of the suspension arm stopper 72 and suspension arm 7 with each other is broken off only by turning down the rear end portion of the suspension arm 7, i.e., turning up the free end portion of thereof around the suspension arm support shaft 71 with the upper portion, which is always in close contact with the inner post cover 64, of the suspension arm stopper 72 pulled forcibly in the forward direction. Namely, in order to transfer the condition of use of the lift shown in FIG. 6 to a folding condition of the suspension arm 7 shown in FIG. 7, it is necessary that the upper portion of the suspension arm stopper 72 be once pulled forward, i.e., in the direction opposite to the direction in which a load is imparted thereto during the use of the lift as the free end portion of the suspension arm 7 is lifted. Thus, the non-intended releasing of the suspension arm stopper 72, which causes the suspension arm 7 to be folded, is prevented, and this is of a help toward the security of the safety of the lift in use.

The traveling lift in the example of FIG. 1 is provided at the free end portion of the suspension arm 7 with a hanger 75 for supporting suspenders used to suspend a physically handicapped person. The hanger 75 in this example comprises a rod type material, and is joined at an intermediate portion thereof to the free end portion of the suspension arm 7 via a hanger support shaft 76 so that the hanger can be turned freely in the horizontal direction. The hanger 75 is provided with a total of three hooks including end hooks 77, 78 at the left and right ends thereof and an intermediate hook 79 at an intermediate lower portion thereof so as to hang thereon metal suspension members of a suspender worn by a person to be nursed. The number of the hooks provided on the hanger 75 and the portions of the hanger 75 on which the hooks are provided may be determined suitably in accordance with the shape of the suspender to be used.

As described above, in the traveling lift in the example of FIG. 1, a combination of the rack gear 63 formed on the rear side surface of the inner post body 61 and pinion gear 82 is used as a driving means. In order to form this driving means as a manual driving means, a worm gear (not shown) for transmitting power to the pinion gear 82 is provided in the gear box 81, and a lifting handle 83 is fitted around an input shaft of the worm gear. Therefore, when an electric motor is used instead of the worm gear in the gear box 81, the driving means can be formed as an electric driving means. The driving means can also be formed as a hydraulic driving means by providing a hydraulic cylinder, for example, on a lower end portion of the inner post body 61.

Figure 8A:
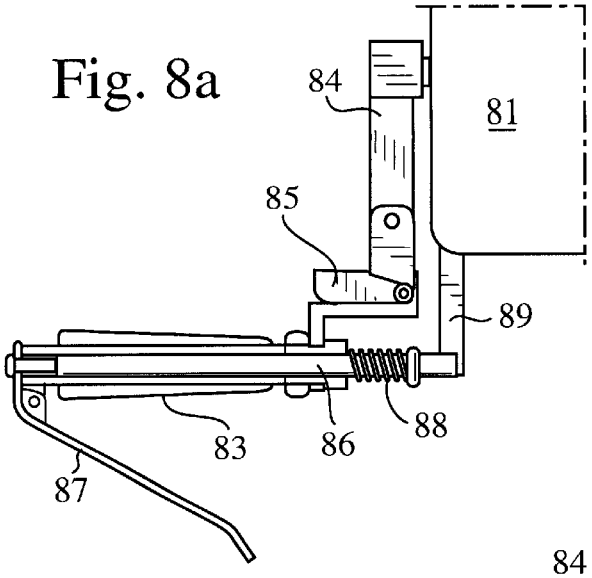
Figure 8B:
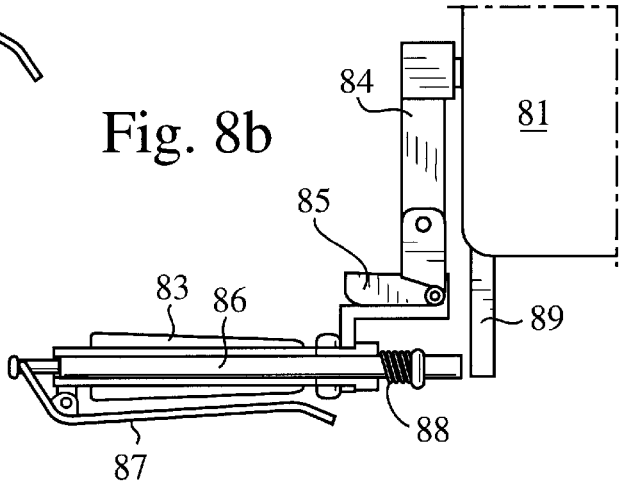
Figure 8C:
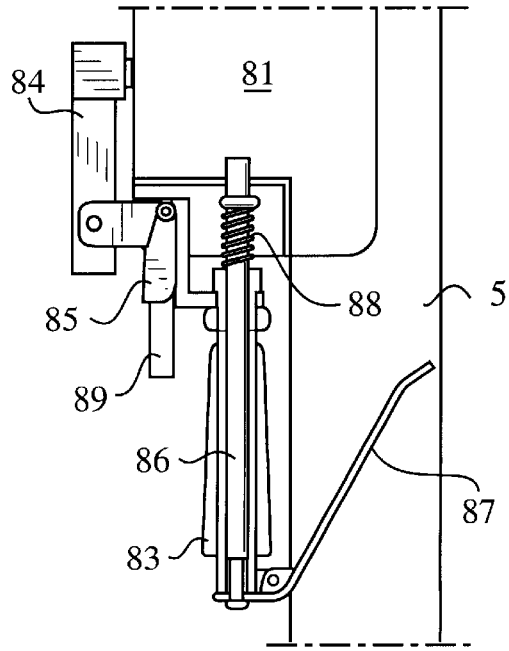

When a manual driving means is employed by providing the lifting handle 83, it is preferable that the lifting handle 83 be also formed foldably. FIGS. 8*a*–8*c* are side views showing an example of a foldably formed lifting handle 83. The lifting handle in 83 this example is joined to the worm gear in the gear box 81 via a handle arm 84 and a folding stopper 85. A handle shaft 86 is inserted in the lifting handle 83, and a grip lever 87 is provided at a front end portion of the handle shaft 86 with a compression spring 88 at a rear end portion thereof which is positioned on the opposite side of the mentioned front end portion.

FIG. 8*a* shows a stopped condition of the lifting handle 83. In this condition, the rearmost portion of the handle shaft 86 functions as a stopper pin. Namely, when the grip lever 87 is left released, the rearmost portion of the handle shaft 86 projects due to the operation of the compression spring 88, and the projecting portion certainly engages a handle stopper 89 extending downward from the gear box 81. Accordingly, even when the hand is released by mistake from the lifting handle 83 during an operation for suspending an object person, the lifting handle 83 does not make more than one turn. Thus, this lifting handle prevents a sudden fall of the object person, and serves to secure the safety of a lifting operation.

FIG. 8*b* shows a pivotable condition of the lifting handle 83, in other words, the condition in which the inner post body 61 can be moved vertically in the support post 5. When the grip lever 87 is grasped with the lifting handle 83, the rearmost portion of the handle shaft 86 is drawn toward the lifting handle 83 to break off the engagement of the handle shaft 86 with the handle stopper 89, so that the lifting handle 83 can be turned freely.

FIG. 8*c* shows the folded condition of the lifting handle 83. When the engagement of the folding stopper 85 joined to a free end portion of the handle arm 84 via a shaft and in a handle arm-engaged condition in FIGS. 8*a* and 8*b* is broken off, the folding stopper 85 is turned at a root portion thereof toward the gear box 81 as shown in FIG. 8*c*, and folded up to a position in which the lifting handle 83 substantially lies on the support post 5.

In the traveling lift in the example of FIG. 1, operating handles 91, 92 are fixed to an upper portion of the gear box 81 for the convenience of moving the lift. When a manual driving means using the lifting handle 83 is employed as a driving means, the lifting handle 83 is turned, for example, by the left hand as the operating handle 92 out of the operating handles 91, 92 is gripped by the right hand. These operating handles thus function effectively so as to stabilize the lift when the lifting handle 83 is turned.

FIG. 9 is a perspective view showing a completely folded condition of the traveling lift according to the present invention shown in FIG. 1. As shown in this drawing, the traveling lift as a whole becomes very compact by lowering the inner post 6 to the lowermost position, folding all of the left and right lateral legs 1, 2, front leg 3, suspension arm 7 and lifting handle 83, and turning the hanger 75 so as to be aligned with the suspension arm 7. For example, even when the lift is formed so that it has a lifting capacity of around 80 kg, and height, width and depth of the lift in the condition of practical use of 950 mm, 800 mm and 900 mm respectively, the length, width and height thereof in a folded condition become as small as 950 mm, 340 mm and 400 mm respectively. Furthermore, when certain kinds of materials are used to form all the members, it is highly possible that a total weight of the lift be set to within around 16 kg.

In order to lift a physically handicapped person sitting on a wheelchair, by using the traveling lift according to the present invention, such belt type suspenders 10 as are shown in FIG. 10 may be used. Metal members at free end portions of the suspenders 10 are hung on the end hooks 77, 78 or intermediate hook 79 of the hanger 75, and the resultant suspender is lifted mainly at the portion thereof which is in the vicinity of the breast of the person to be nursed. In the illustrated condition, the inner post 6, i.e. the suspension arm 7 is moved up by turning the lifting handle 83, and the object person is then separated from the wheelchair as the lift is moved back by gripping the left and right operating handles 91, 92.

For example, in order to transfer a person to be nursed from a wheelchair to the interior of a passenger car, the head portion of him in a suspended state may first be put thereinto. In a concrete procedure for this operation, first, the head portion of the object person is put into the interior of a passenger car, and the suspension arm 7 is then lifted up to a position in which the bottom of him exceeds the height of the seat of the passenger car. The lift is moved until the bottom of the object person reaches a central portion of the seat, and then the object person is directed so as to face in the direction of advance of the car, by turning the hanger 75 horizontally. The suspension arm 7 is lowered to make the person sit on the seat, and the suspender 10 is removed to complete the operation for loading the object person into a passenger car. The lift may be folded and placed in a trunk of the passenger car.

As described previously, employing as the hanger 75 a rod type member which can be turned horizontally has the following advantages. (1) First, a person to be nursed can be suspended at the portion of him which is in the vicinity of the breast. Accordingly, the vibration of the suspended person decreases to an extremely low level as compared with that in a case where an object person is suspended at the portion of a suspender which is above his head, and it becomes possible to carry out a stable suspending operation, and transfer a suspended object person in a low position with ease. (2) Since the hanger 75 is turned horizontally, the direction in which an object person faces can be changed laterally with ease.

When the end hooks 77, 78 are provided on both end portions of the hanger 75 as mentioned above, a nursing person, who operates the lift, longitudinally slides left and right belts of the suspenders 10 hung on the end hooks 77, 78, whereby the angle of the back of the suspended object person can be changed. Therefore, the suspenders 10 can be operated as if they were provided with a reclining mechanism. In order to have the left and right belts of the suspenders 10 slide in a well-balanced condition, a mechanism for linking the end hooks 77, 78 together in the hanger 75 may be provided.

The traveling lift according to the present invention can also be utilized to transfer baggage of large weight. FIG. 11 is a perspective view showing baggage P being loaded into a trunk of a passenger car C by using the traveling lift according to the present invention.

Since the leg unit of the traveling lift according to the present invention is formed substantially in the shape of the letter "L", the lift can be moved very easily even in a narrow passage. When a space in which the front leg only is inserted can be secured, a person to be nursed can be transferred from a wheelchair to the interior of a passenger car, and vice versa, and to various other places, such as a bed and bathtub for the nursing purposes. Moreover, this lift as a whole can be folded compactly, and the weight thereof can be reduced, so that the transporting of the lift and the storing of the same while it is not in use can be done very easily.

Since a physically handicapped person can be suspended at the part of him which is in the vicinity of his breast, short suspenders to be hung on the suspension arm meet the purpose, so that the person being suspended and lifted is rarely swung. This enables an object person in a sitting posture to be suspended and transferred stably.

When a combination of upper and lower guide rollers and a rack and a pinion gear is used as a driving means, the vertical movements of the suspension arm can be made lightly and smoothly. The traveling lift according to the present invention is a safe lift formed with consideration given to the prevention of accidents ascribed to the non-intended folding of the members and a sudden fall of a suspended person.

What is claimed is:

1. A traveling lift comprising:

a leg unit consisting of two short left and right lateral legs and one long front leg which are provided with casters at end portions of said short and long legs, and which are joined together at root portions to be formed into a substantially T-shaped structure, a tubular support post set up on said root portions of said leg unit, an inner post inserted in said support post and provided with a suspension arm at a front portion of said leg unit, and wherein said suspension arm is disposed above and substantially in parallel with said front leg, said inner post is moveable in the vertical direction of said support post by a driving means, and said two lateral legs and one front leg are foldable and said suspension arm is foldable with said inner post.

2. A traveling lift according to claim 1, wherein said driving means comprises:

an upper guide roller for supporting a front side surface of said inner post at the portion of said tubular support post which is adjacent to an upper end of a front leg-side portion, a lower guide roller for supporting a rear inner wall of said tubular support post at the portion of said inner post which is adjacent to a lower end, a rack gear formed on a rear side surface of said inner post, and a pinion gear engaged with said rack gear for receiving power from a worm gear driven by a handle.

* * * * *